US007004629B2

(12) United States Patent
Shrader et al.

(10) Patent No.: US 7,004,629 B2
(45) Date of Patent: Feb. 28, 2006

(54) METHOD AND APPARATUS FOR HANGING A RESEALABLE BAG

(76) Inventors: Arthur Joseph Shrader, 11 Creekwood Cir., Richardson, TX (US) 75080; Harold Edward Shrader, 3715 W. Ridge Rd., Gary, IN (US) 46408

( * ) Notice: Subject to any disclaimer, the term of this patent is extended or adjusted under 35 U.S.C. 154(b) by 0 days.

(21) Appl. No.: 10/896,388

(22) Filed: Jul. 22, 2004

(65) Prior Publication Data

US 2005/0018931 A1 Jan. 27, 2005

Related U.S. Application Data

(60) Provisional application No. 60/490,088, filed on Jul. 26, 2003.

(51) Int. Cl.
*B65D 33/14* (2006.01)
*B65D 33/16* (2006.01)

(52) U.S. Cl. ..... 383/23; 383/13; 383/64; 24/415

(58) Field of Classification Search ..... 383/23, 383/64, 68–69, 13; 24/415, 429
See application file for complete search history.

(56) References Cited

U.S. PATENT DOCUMENTS

| | | | | |
|---|---|---|---|---|
| 3,462,068 | A | 8/1969 | Suominen | |
| 3,486,683 | A * | 12/1969 | Kamins et al. | 383/23 |
| 4,000,768 | A | 1/1977 | Siegel | |
| 4,792,983 | A * | 12/1988 | Allegre | 383/13 |
| 5,283,932 | A * | 2/1994 | Richardson et al. | 24/400 |
| 5,908,245 | A | 6/1999 | Bost et al. | |
| 6,526,632 | B1 * | 3/2003 | Blythe et al. | 24/400 |
| 2003/0210836 | A1 | 11/2003 | Strand | |

* cited by examiner

*Primary Examiner*—Jes F. Pascua
(74) *Attorney, Agent, or Firm*—Stephen S. Mosher

(57) ABSTRACT

There is disclosed a variety of adapter hooks and methods for supporting individual resealable storage bags on a support rod, at any available location along the support rod without requiring the removal of other storage bags supported on the support rod, comprising a closure slider of the resealable storage bag modified to include a support hook adapter configured to be attached to the closure slider, extending from an upper portion of the closure slider and dimensioned to receive the support rod.

41 Claims, 6 Drawing Sheets

METHOD AND APPARATUS FOR HANGING A RESEALABLE BAG

CROSS-REFERENCE TO RELATED APPLICATION

The present U.S. Patent Application claims priority from earlier filed U.S. Provisional Patent Application Ser. No. 60/490,088, filed Jul. 26, 2003 and entitled "Sliding Bag Hook."

BACKGROUND OF THE INVENTION

1. Field of the Invention

The present invention generally relates to storage or packaging systems using resealable bags and, more particularly, to improved apparatus and methods for supporting such bags on a support rod of a storage or display rack, without having to first remove other bags from the support rod.

2. Description of the Prior Art

Many different kinds of plastic storage bags are presently available for storing all kinds of goods to protect the goods from deterioration or contamination, or just as a means of packaging various types of products. Among the more useful of plastic bags for storing goods are those that are equipped with resealable closures, which enable secure closure and re-use of the bag. An example of a typical resealable storage bag is illustrated in FIG. 1. The bag is sealed by moving the slider in one direction and unsealed by moving the slider in the opposite direction.

One disadvantage of the conventional resealable storage bag is that there is no convenient way to hang the bag, along with other similar bags, in an organized fashion. U.S. Pat. No. 5,908,245 issued to Bost, et al., discloses a resealable bag having a centrally-positioned tab attached to the upper part of the bag with a hole provided through the tab for hanging the bag on an open ended rod. Published U.S. patent application Ser. No. US2003/0210836 issued to Strand, discloses a resealable bag with a tab extension from the slider that includes a hole in the tab, also for hanging the bag on an open ended rod. The requirement for an open ended rod is a disadvantage because a bag having a hole as the only means for hanging the bag requires the removal of other bags that may be hung on the same support rod in order to access the bag of interest. Removal of several or many such storage bags, particularly if they must be removed and replaced in a specific sequential order, is a laborious and time-consuming process. Moreover, a rod supported only at one end cannot support as much weight as a rod supported at both ends.

Other solutions in the prior art include U.S. Pat. No. 4,000,768 issued to Siegel and U.S. Pat. No. 3,462,068 issued to Suominen, both of which provide a centrally located hook fixed to the upper part of the resealable bag. These solutions provide a hook for hanging on a rod supported at both ends, an improvement over bags that lack such a hook. However, the fact that the hooks are fixed to the bag limits the usefulness of the resealable storage bag because the hook cannot be moved to offset an unevenly distributed load in the bag. Moreover, it would be advantageous if the resealable bags did not have to be redesigned to provide a hook integrated with a slider device for sealing and unsealing the bag.

What is needed, therefore is an adapter hook for supporting resealable bags on any kind of support rod, open ended or supported at both ends, that is easily attached to the slider of resealable bags of various sizes and styles.

SUMMARY OF THE INVENTION

Accordingly there is disclosed an adapter hook for supporting individual resealable storage bags on a support rod, comprising a closure slider of the resealable storage bag modified to include a support hook adapter configured to be attached to the closure slider, extending from an upper portion of the closure slider and dimensioned to receive the support rod, wherein the resealable bag modified with the adapter hook may be hooked over the support rod at any available location along the support rod without requiring the removal of other storage bags supported on the support rod. In an alternate embodiment, the support hook is formed as an integral part of the slider.

In another aspect of the invention, there is disclosed a method for supporting individual resealable bags on a support rod, comprising the steps of modifying the closure slider of the resealable storage bag to include a support hook adapter configured to be attached to the closure slider and extending from an upper portion of the closure slider to form an adapter hook; and dimensioning the support hook adapter to receive the support rod, wherein the resealable bag having the support hook thus integrated with the closure slider of the resealable storage bag may be hooked over the support rod at any available location along the support rod without requiring the removal of other storage bags supported on the support rod.

DETAILED DESCRIPTION OF THE INVENTION

Figure 1:
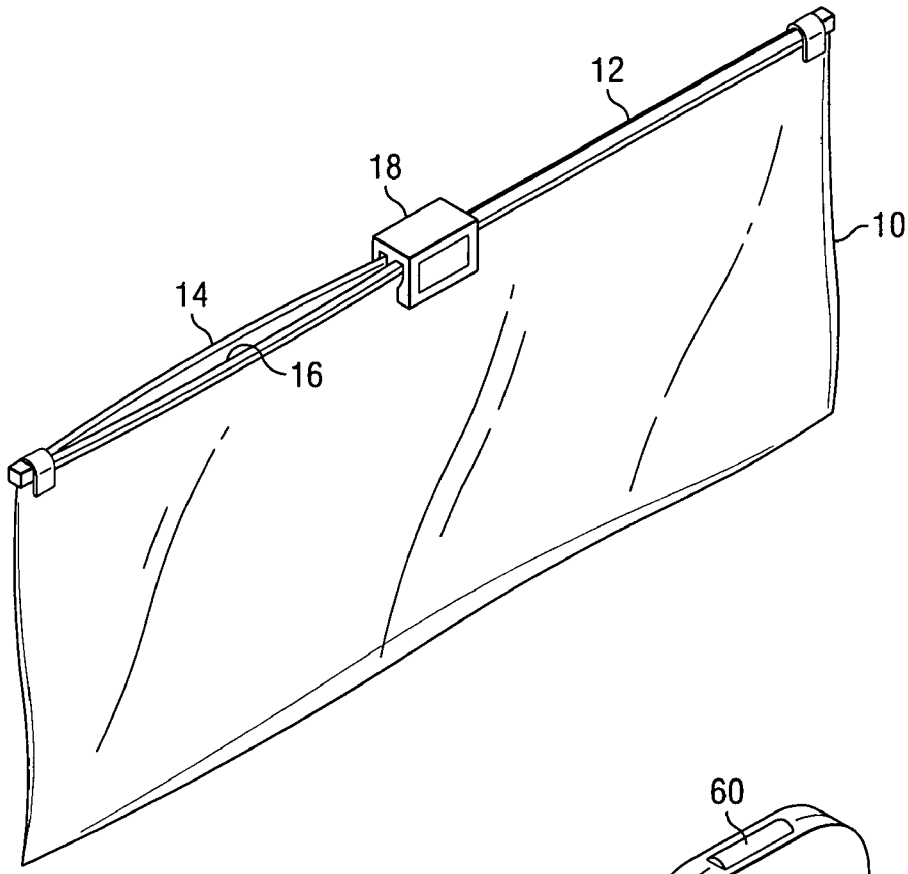
FIG. 1 (PRIOR ART)
FIG. 1 illustrates a typical example of a prior art resealable storage bag having a slider device for sealing and unsealing the opening of the bag.

Referring to FIG. 1, there is illustrated a typical example of a prior art resealable storage bag 10 having a slider device 18 (also referred to herein as a slider 18) for sealing and unsealing the opening of the bag. The storage bag 10 shown includes a sealed portion 12 of the opening of the storage bag 10 and an unsealed portion wherein first and second 14, 16 unsealed edges are also visible in the drawing. The bag closure mechanism functions in the manner of a zipper as slider 18 is moved in one direction to seal the bag and in the opposite direction to unseal the bag. The storage bag 10 may typically be fabricated of any of the many readily available thin, flexible membrane materials such as, e.g., transparent plastic, so that the contents are visible. The storage bag 10 is available in many configurations and sizes, with properties that match the intended applications. For example, such bags may be widely used to store food, clothing and products of all kinds. Their versatility and adaptability make them ideally suited to a whole host of commercial and consumer applications. Many of those applications involve storing the bags on a variety of storage or display racks or in a variety of enclosures.

Figure 2:
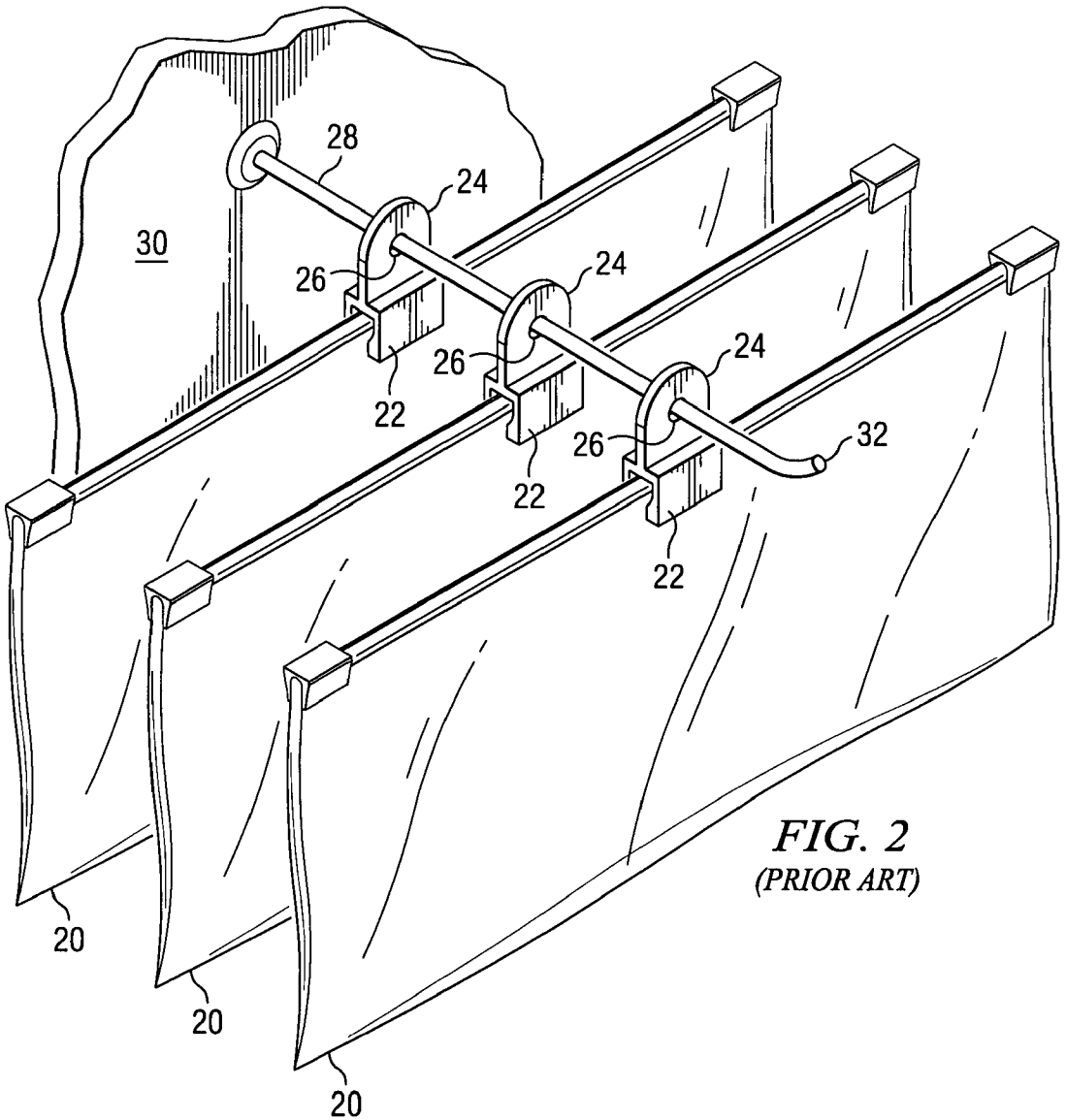
FIG. 2 (PRIOR ART)
FIG. 2 illustrates another prior art resealable storage bag having a slider device that includes a tab having a hole punched therein for hanging the bag on an open-ended support rod, the support rod shown further including several such storage bags supported thereon.

What has not been adequately addressed, however, is to solve the problem of providing organized storage for a plurality of resealable storage bags in a convenient way. Thus, FIG. 2 illustrates another prior art resealable storage bag 20 having a slider device 22 that includes a tab 24 having a hole 26 formed therein for hanging the bag on a support rod 28, the support rod shown further including several such storage bags supported thereon. The support rod 28 shown is supported at one end to a surface 30, which may be a wall, a display rack, the inside of a cabinet or closet, and the like. Further, the support rod 28 is open ended at the end 32 opposite the end that is supported on the surface 30. This system has several disadvantages. First, that removal or insertion of a bag 20 from or into a particular position requires the sequential removal, and perhaps replacement, of other storage bags in order to access the particular position. Second, a rod supported only at one end is very limited in the amount of weight of storage bags and their contents that the rod can support.

Figure 3:
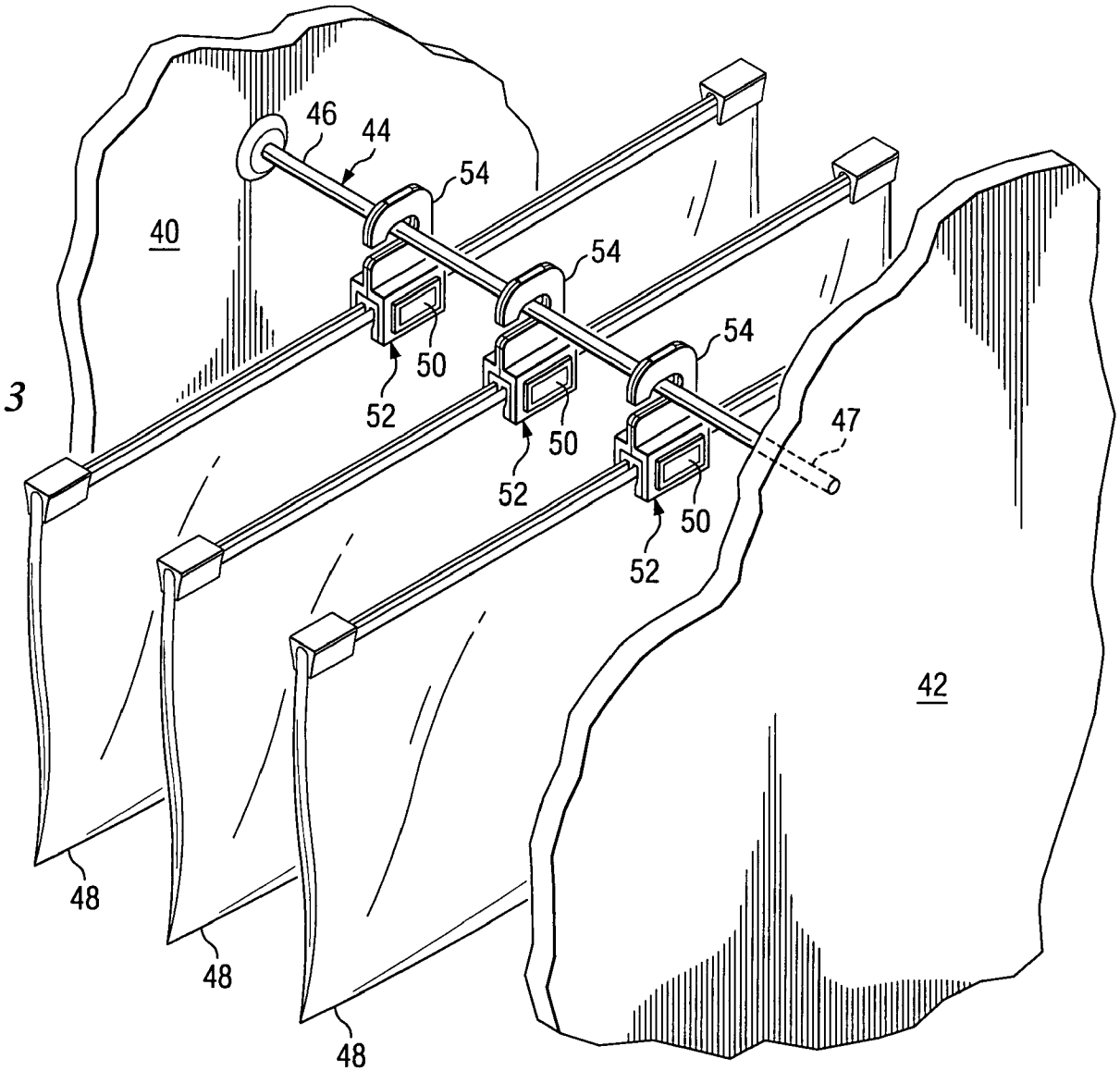
FIG. 3 illustrates a resealable storage bag having a slider device modified according to one illustrative embodiment of the disclosed invention with a support hook adapted for hanging a storage bag on a support rod, which may be supported at both of its ends, without having to remove any other storage bag from the rod.

FIG. 3 illustrates a plurality of resealable storage bags 48, each having a slider device 50 modified according to one illustrative embodiment of the disclosed invention with a support hook adapter 52 having a hook 54 adapted for hanging the storage bag 48 on a support rod 44, which may be supported between two surfaces 40, 42, at both of its ends, e.g., at 46 and 47, without having to remove any other storage bag from the rod. Many more storage bags may be supported on a storage rod supported at both ends, for a given size of storage rod and storage bags. Further, any individual bag equipped with an adapter hook according to the present invention may be located anywhere on the storage rod may be removed or installed without having to remove other bags beforehand to gain access to the position for the bag.

Figure 4B:
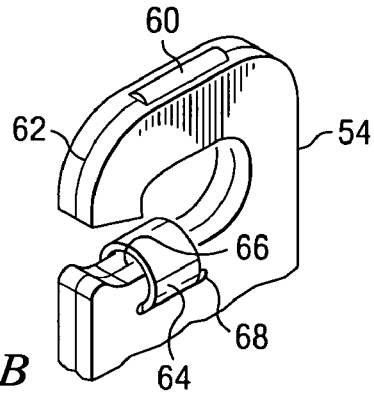
FIG. 4B illustrates an alternate embodiment of the adapter hook shown in FIG. 4A.
Figure 4A:
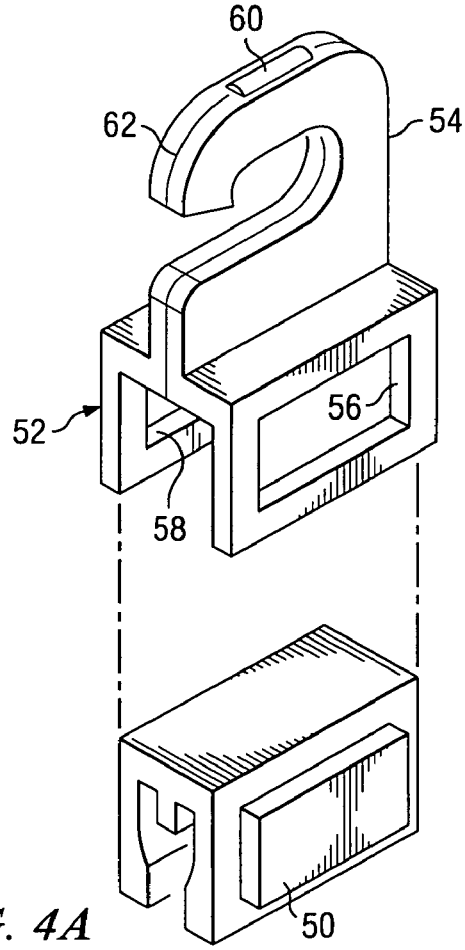
FIG. 4A illustrates one embodiment of an adapter hook for modifying a slider of a resealable storage bag according to the present disclosure.

Referring to FIG. 4A, there is illustrated one embodiment of an adapter hook for modifying a slider of a resealable storage bag according to the present disclosure. The adapter hook 52 may be fabricated as an injection molded component and assembled from two hinged-together, mirror-image halves to form a hook portion 54 when folded together along a living hinge 60. A distal end of each mirror-image half is formed as a skirt having an opening 56, 58 sized to fit around the body of a slider 50 of a resealable storage bag 48. The mirror-image halves of the adapter hook may be configured to snap together after being folded toward each other, forming a joint 62, as will be described in further detail below in conjunction with FIGS. 5A and 5B. The adapter hook 52 may be fabricated of a thermoplastic material such as polypropylene having the strength, flexibility and other properties adequate to support the intended loads stored in the resealable bag 48.

FIG. 4B illustrates an alternate embodiment of the adapter hook shown in FIG. 4A, wherein an inverted, U-shaped, resilient clip 64 (also referred to in this specification as a spring clip) is fitted over the folded mirror-image halves of the adapter hook 52 at a location 66 near a throat portion of the adapter hook 52. The clip 64 acts to firmly secure the mirror-image halves together just below the hook portion 54 of the adapter hook 52. A pair of grooves 68, each disposed on opposite sides of the adapter hook 52 are provided to retain the clip 64 in position. When installed, the lower edges of the clip 64 engage the grooves 68 to retain the clip 64 against the body of the adapter hook 52 at the location 66. The clip may preferably be fabricated of a resilient metal spring stock such as spring steel. The embodiments of the adapter hooks of FIGS. 4A and 4B are illustrative of those embodiments that simply clamp on or around the existing closure slider of the resealable storage bag. Thus, no modification to the structure of the slider is required.

Figure 5A:
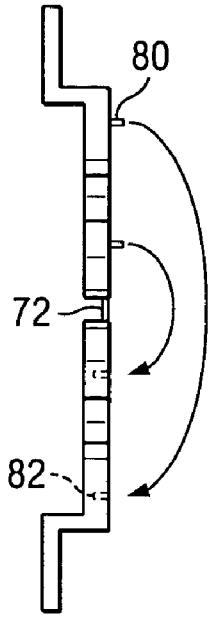
FIG. 5A illustrates one side of one method of constructing the adapter hook embodiment shown in FIGS. 4A and 4B.
Figure 5B:
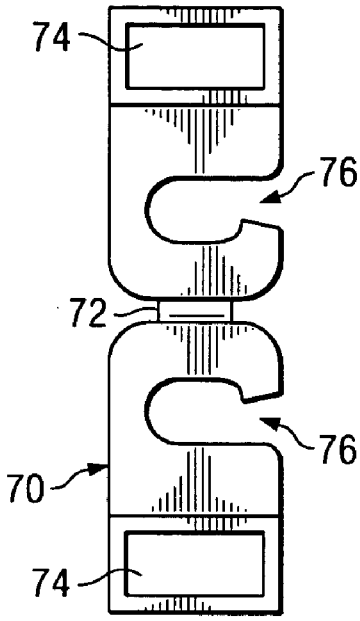
FIG. 5B illustrates a plan view of the one method of constructing the adapter hook embodiment shown in FIG. 5A.
Figure 5C:
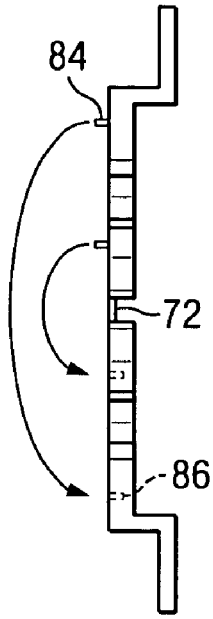
FIG. 5C illustrates the other side of the one method of constructing the adapter hook embodiment shown in FIGS. 5A and 5B.

Referring to FIGS. 5A, 5B, and 5C there is illustrated an alternate method of constructing the adapter hook embodiment shown in FIGS. 4A and 4B. The adapter hook 70 is fabricated from two hinged-together, mirror-image halves to form a hook portion 76 when folded together along a living hinge 72, wherein a distal end of each half is formed as a skirt having a void or opening 74 sized to fit around the body of a slider 50 of a resealable storage bag 48. The mirror-image halves of the adapter hook may be configured to snap together after being folded toward each other, as indicated by the arrows in FIGS. 5A and 5C. The inside surfaces of the mirror-image halves may include integral, two-piece locking fasteners 80, 82 and 84, 86 to secure the halves together when the halves are folded and brought together in contact. The locking fasteners may comprise a pawl 80, 84 and a ledge or slot 82, 86 respectively disposed on opposing sides or halves such that when brought together, the pawl portion 80, 84 enters and is retained by the slot portion 82, 86 with sufficient tension to tightly clamp the halves together. Alternatively, the locking fastener may be configured as a tab member (not shown) having a lip (not shown) formed at a distal end of one of the mirror-image halves that engages a shoulder step (not shown), formed in the distal end of the mirror-image half, when the halves are pressed together. Other possible alternative two-piece locking fasteners well-known in the art may include a garment type snap fastener (not shown) or a stud and grommet fastener (not shown). Many variations of such locking fasteners are possible, the intent herein being to illustrate several possible ways to implement the locking fastener to secure the hinged halves together. Any locking fastener employed should, of course, be configured for repeated cycles of reuse. The adapter hook 70 may be fabricated, including the locking fastener features, e.g., by injection molding, of a thermoplastic material such as polypropylene having the strength, flexibility and other properties adequate to provide the living hinge feature and support the intended loads stored in the resealable bag 48. Such material provides a molded article that is rigid yet includes a so-called "living hinge" that retains its flexibility and durability through many repetitions of assembly and disassembly cycles.

Figure 5D:
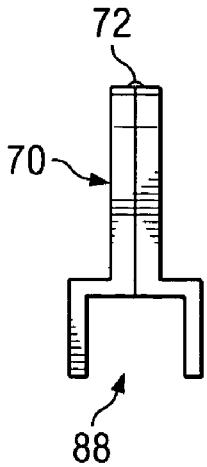
FIG. 5D illustrates an assembled adapter hook according to the embodiment shown in FIGS. 5A, 5B and 5C.
Figure 5E:
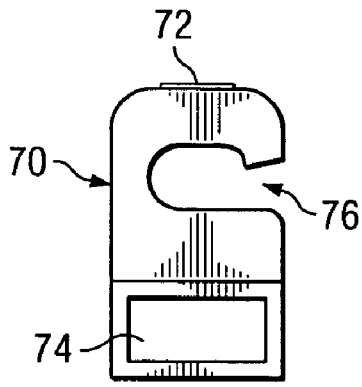
FIG. 5E illustrates an assembled adapter hook according to the embodiment shown in FIG. 5D.
Figure 5F:
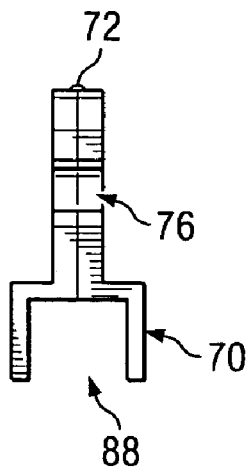
FIG. 5F illustrates an assembled adapter hook according to the embodiment shown in FIG. 5E.

Referring to FIGS. 5D, 5E, and 5F, there is illustrated an assembled adapter hook 70 according to the embodiment shown in FIGS. 4A, 4B, and FIGS. 5A, 5B and 5C. In use, the adapter hook 70 is held in a slightly opened disposition while the openings 74 are brought into position over the sides of the body of the slider 50 (see FIG. 4A). As the halves of the adapter hook 70 are brought into contact, the halves are secured by the locking fasteners 80, 82 and 84, 86 and the openings 74 (see FIG. 5A) snugly entrap the respective sides of the body of the slider 50 (see FIG. 4A). Another and simpler alternative to the construction illustrated in FIGS. 5A through 5F is a solid, molded or stamped adapter hook having a substantially flat bottom surface (not shown) that may be attached to the upper surface of the closure slider by an adhesive bond. This embodiment would be similar to FIGS. 5D through 5F but without the skirt portions and without having to assemble the mirror-image halves together.

Figure 6A:
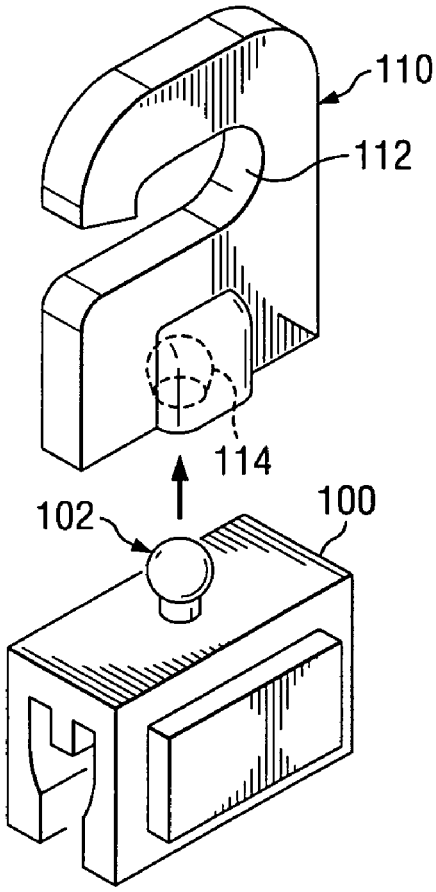
FIG. 6A illustrates yet another alternate embodiment of an adapter hook for modifying a slider of a resealable storage bag according to the present disclosure.

Referring to FIG. 6A there is illustrated an alternate embodiment of an adapter hook 110 for modifying a slider 100 of a resealable storage bag according to the present disclosure. The slider 100 is configured similarly to the slider 50 of FIG. 4A, except that the slider 100 includes a ball-shaped member, i.e., a ball member 102, preferably secured to the central portion of the top surface of the slider 100. The ball member 102 is configured to fit into a receptacle or socket 114 to attach the adapter hook 110 to the slider 100, thus forming a rotatable joint. The ball-and-socket feature is configured such that when the ball and socket portions are placed into contact with each other, the ball portion is partially nested within the socket portion, either portion being sufficiently resilient to allow the ball portion to "snap into" the socket portion under a tension force approximately equal to the maximum practical weight of contents that maybe contained within the resealable storage bag.

Figure 6B:
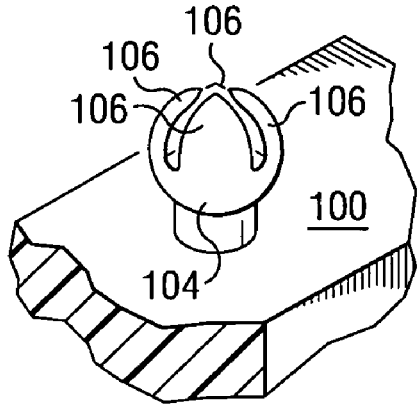
FIG. 6B illustrates yet another alternate embodiment of the adapter hook of FIG. 6A for modifying a slider of a resealable storage bag according to the present disclosure.

In an alternate embodiment illustrated in FIG. 6B according to the present invention, the ball member may be modified by splitting it part way along an axis of rotation 108 to form several leaves or fingers 106 to implement the split ball member 104. The split ball member 104, being formed of a resilient thermoplastic material, may then more readily snap into a corresponding receptacle or socket 114 on the underside of the adapter hook 110. A split ball member enables repeated cycles of assembly or disassembly of the ball member and socket joint. The receptacle or socket 114 is configured to retain the ball member 102, or the split ball member 104, therein, while permitting the adapter hook 110 to rotate on the ball member when it is desired to rotate the resealable bag (48 in FIG. 3). Rotating the resealable bag may facilitate inspection or display of the contents. It should be noted that the ball-and-socket embodiment may be implemented by modifying the design and/or manufacture of the closure slider 100 used on a standard resealable storage bag.

Figure 6C:
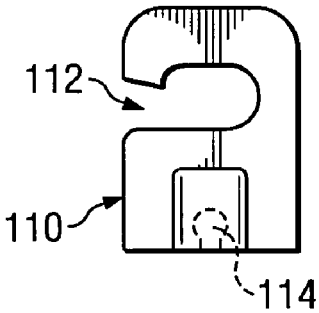
FIG. 6C illustrates another view of the embodiment shown in FIG. 6A.
Figure 6D:
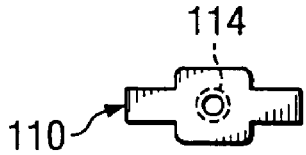
FIG. 6D illustrates another view of the embodiment shown in FIG. 6C.

Referring to FIGS. 6C and 6D, there are illustrated respectively a side view and a bottom view of the embodiment shown in FIG. 6A. In the side view, the socket portion 114 of the ball-and-socket fastener is shown in phantom to show its relative position in the structure of the adapter hook 110. Similarly, the bottom view shows the socket portion 114 as it appears from the bottom of the adapter hook 110. In some adapter hooks, the body is thick enough to fully enclose the socket portion 114 without bulges in the sides of the adapter hook body. In other implementations, particularly smaller sizes of adapter hooks, side bulges, as illustrated in FIG. 6A, will be required.

Figure 7:
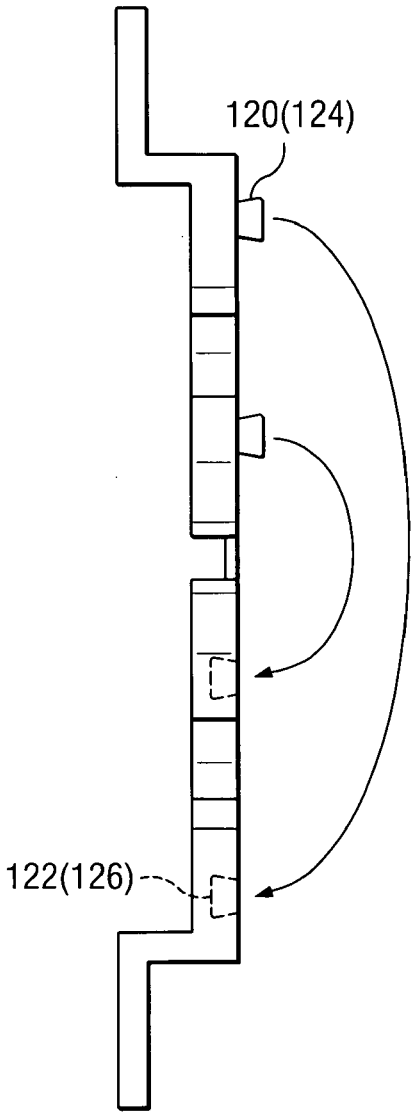
FIG. 7 illustrates an alternate embodiment of the embodiment shown in FIGS. 5A, 5B, and 5C.
Figure 8:
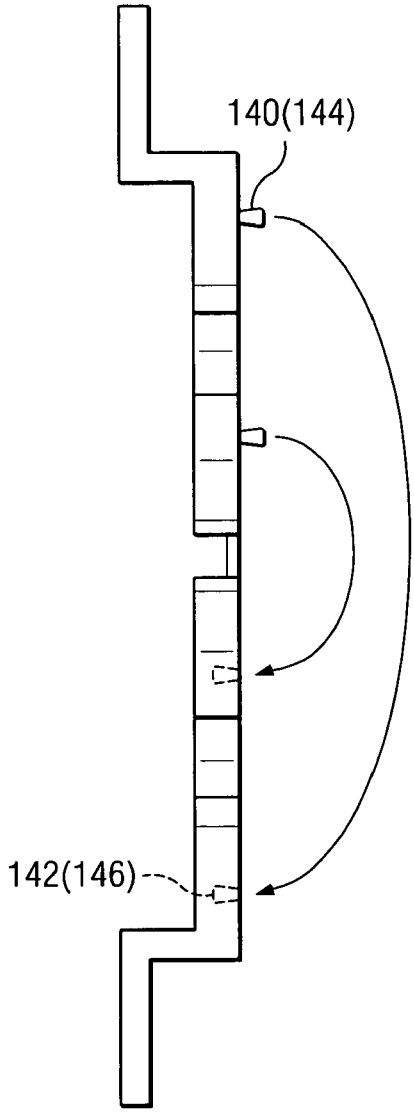
FIG. 8 illustrates another alternate embodiment of the embodiment shown in FIGS. 5A, 5B, and 5C.

A variant of the ball-and-socket fastener that may be used is a snap fastener shown in FIG. 7 and having a first (male) portion 120 and a second (female) portion 122, which, when pressed together "snap" into position because of the intended slight interference fit between them. An alternative to this variant is a two-piece stud and grommet fastener shown in FIG. 8 and having a first (stud) portion 140, and a second (grommet) portion 142, which, when pressed together "snap" into position because of the slight interference fit between them. In both FIGS. 7 and 8, the action of the locking fastener is similar to connecting a plug and receptacle. FIGS. 7 and 8 mimic and illustrate alternate embodiments to FIGS. 5A and 5C, which show opposite edges of the same structure.

The embodiments of FIGS. 4A & 4B, 5A through 5F, and 6A through 6D are provided to illustrate several of the ways the present invention may be implemented. Some variations are contemplated that do not require changing the design or production of the closure slider or slider device of the resealable storage bag, whereby the adapter hook may be installed and used with existing resealable bags. The embodiments of FIGS. 4A, 4B, and 5A through 5F, and the simpler molded or stamped hook attached to the slider by adhesion bonding, are examples that do not require structural modification to the slider of the resealable bag.

In other variations, the application maybe better suited to an implementation that makes use of a revised design of the closure slider device, whether the hook feature is detachable or is made a permanent, integral part of the closure slider or slider device. The adapter hook may be assembled and supplied with the resealable bag, or sold separately to be attached to the bag by the user. Further, in some embodiments the adapter hook may be removed and attached as needed for a specific reuse of the resealable storage bag. Moreover, with any of the adapter hooks illustrated and described herein, the shape of the end portion of the hook, i.e., the tip of the hook may be configured to minimize slippage of the adapter hook 110 supporting a resealable bag when jostled by a user. In FIG. 6B, the tip of the adapter hook 110 is not rounded but is instead formed to an inward and downward directed point. Such a construction or similar variations thereof retain the adapter hook in position on a support rod and require the user to lift the resealable storage bag and its hook slightly before it may be unhooked from the support rod.

In another modification, instead of providing an opening in a skirt portion of each of the first and second mirror-image halves of the adapter hook to just fit over the proximate first and second opposite sides of the body portion of the slider body, as in FIGS. 3 and 4A, the lower, inside portion of each of the first and second mirror-image halves of the adapter hook may be configured one of a pair of jaw surfaces disposed in opposing relationship to grip the resealable storage bag just beneath sealing ribs laterally disposed across the upper end of the resealable storage bag. Thus, all of the above variations are contemplated, with these exemplary embodiments presented herein to suggest that a variety of approaches are certainly possible as will occur to persons skilled in the art, without departing from the spirit of the invention as set forth in the following claims.

What is claimed is:

1. A method for supporting a storage bag, resealable at an upper end with a closure slider, that enables individual resealable bags to be installed on or removed from a support rod without requiring sequential installation or removal of other storage bags supported on the rod, comprising the steps of:

providing an adapter hook having a hook portion dimensioned to receive the support rod and a body portion of a folding, clamshell-like construction fabricated of a thermoplastic resin; and installing the body portion of the adapter hook having the folding, clamshell-like construction on the slider of the resealable storage bag;

wherein the resealable bag having the adapter hook thus installed on the closure slider of the resealable storage bag may be hooked over the support rod at any available location along the support rod without requiring the removal of other storage bags supported on the support rod.

2. The method of claim 1, wherein the step of installing comprises the steps of:

folding inside surfaces of first and second mirror-image halves of the adapter hook, hinged along an upper side in clamshell fashion, toward each other;

aligning an opening in a skirt portion of each of the first and second mirror-image halves of the adapter hook proximate first and second opposite sides of a body portion of the closure slider, wherein each opening in the skirt portion is shaped and sized to just fit over the respective opposite side of the body portion of the closure slider;

pressing the inside surfaces of the first and second mirror-image halves toward each other and over the first and second opposite sides of the body portion of the closure slider until the respective inside surfaces of the adapter hook contact the resealable bag; and causing, under continued pressure, at least one set of locking fasteners having first and second members thereof disposed on respective first and second inside surfaces of an upper portion of the first and second mirror-image halves of the adapter hook to snap together, thereby securing the adapter hook to the closure slider of the resealable bag.

3. The method of claim 2, wherein the step of folding comprises the step of bending the first and second mirror-image halves of the adapter hook along a living hinge disposed along a boundary between the first and second mirror-image halves of the adapter hook.

4. The method of claim 2, wherein the step of aligning comprises the step of placing the shaped and sized opening in the skirt of the first or second of the mirror-image halves of the adapter hook around and over the respective proximate side of the body portion of the closure slider.

5. The method of claim 2, wherein the step of causing comprises the step of pressing each first and second member of the set of locking fasteners toward each other into an aligned relationship until a locked condition occurs.

6. The method of claim 5, wherein the locking fastener is formed as a garment snap fastener.

7. The method of claim 5, wherein the locking fastener is formed as a pawl and ledge combination fastener.

8. The method of claim 5, wherein the locking fastener is formed as a stud and grommet fastener.

9. The method of claim 5, wherein the locking fastener is reusable.

10. An adapter hook for supporting a storage bag, the storage bag being resealable at an upper end with a closure slider, that enables individual resealable bags to be installed on or removed from a support rod without requiring sequential installation or removal of other storage bags supported on the rod, comprising:

an adapter hook having a folding clamshell-like construction fabricated of a thermoplastic resin, and configured with a hook portion dimensioned to receive the support rod and a body portion configured for securing the adapter hook to the closure slider of the resealable bag;

wherein the adapter hook further comprises:

(a) a clamshell-like construction configured with first and second mirror-image halves coupled together via a living hinge along a common border at an upper end of the adapter hook whereby the first and second halves may be folded toward each other;

(b) an opening in a skirt portion of each of the first and second mirror-image halves of the adapter hook, wherein each opening in the skirt portion is shaped and sized to just fit over a proximate first and second opposite sides of a body portion of the closure slider; and (c) at least one set of locking fasteners having first and second members thereof disposed on respective first and second inside surfaces of an upper portion of the first and second mirror-image halves of the adapter hook and configured to snap and lock together when the first and second halves are pressed toward each other to secure the adapter hook to the closure slider of the resealable bag.

11. The adapter hook of claim 10, wherein each first and second member of the set of locking fasteners have a plug and receptacle relationship such that an aligned relationship is enabled until a locked condition occurs when pressed toward each other.

12. The adapter hook of claim 11, wherein the set of locking fasteners is formed as a garment snap fastener.

13. The adapter hook of claim 11, wherein the set of locking fasteners is formed as a pawl and ledge combination fastener.

14. The adapter hook of claim 11, wherein the set of locking fasteners is formed as a stud and grommet fastener.

15. The adapter hook of claim 11, wherein the set of locking fasteners is reusable.

16. The adapter hook of claim 10, wherein instead of having an opening in a skirt portion of each of the first and second mirror-image halves of the adapter hook, shaped and sized to just fit over proximate first and second opposite sides of a body portion of the closure slider, the lower, inside portion of each of the first and second mirror-image halves of the adapter hook is configured with one of a pair of jaw surfaces disposed in opposing relationship to grip the resealable storage bag just beneath sealing ribs laterally disposed across the upper end of the resealable storage bag when the first and second halves of the adapter hook are pressed toward each other.

17. The adapter hook of claim 16, wherein the jaw surfaces disposed in opposing relationship in the lower, inside portion of the first and second halves of the adapter hook are shaped to grip the resealable storage bag material without puncturing the material.

18. A method for supporting a storage bag, resealable at an upper end with a closure slider, that enables individual resealable bags to be installed on or removed from a support rod without requiring sequential installation or removal of other storage bags supported on the rod, comprising the steps of:

modifying the closure slider of the resealable storage bag to include a first member of a ball-and-socket fastener disposed on an upper-most surface thereof;

providing an adapter hook fabricated of a thermoplastic resin and having a hook portion dimensioned to receive the support rod and a body portion having a second member of the ball-and-socket fastener disposed on a lower-most surface thereof; and installing the body portion of the adapter hook having the second member of the ball-and-socket fastener disposed on a lower-most surface thereof on the closure slider of the resealable storage bag having the first member of a ball-and-socket fastener disposed on an upper-most surface thereof;

wherein the resealable bag having the adapter hook thus installed on the closure slider of the resealable storage bag may be hooked over the support rod at any available location along the support rod without requiring the removal of other storage bags supported on the support rod.

19. The method of claim 18, wherein the step of installing comprises the steps of:

aligning the second member of the ball-and-socket fastener on the body portion of the adapter hook proximate the first member of the ball-and-socket fastener on the body portion of the closure slider, wherein each member of the ball-and-socket fastener is configured to be coupled with the other member of the ball-and-socket fastener; and causing the first and second members of the ball-and-socket fastener to engage when pressed together, thereby securing the adapter hook to the closure slider of the resealable bag.

20. The method of claim 19, wherein the step of aligning comprises the step of placing the first and second members of the ball-and-socket fastener in contact with each other such that the ball member is partially nested within the socket member prior to being pressed together.

21. The method of claim 18, wherein the step of causing comprises the step of pressing each first and second member of the ball-and-socket fastener toward each other until the ball member and the socket member of the ball-and-socket fastener snap into a fully nested relationship with each other.

22. The method of claim 18, wherein the ball-and-socket fastener formed in the adapter hook and the closure slider permits rotation of the ball member within the socket member such that the resealable storage bag may be rotated while supported on the support rod.

23. The method of claim 18, wherein the ball-and-socket fastener formed in the adapter hook and the closure slider is reusable.

24. The method of claim 23, wherein the ball member portion of the ball-and-socket fastener is longitudinally split part way along an axis of coupling to provide resilience in the ball member and enable repeated assembly and disassembly of the ball-and-socket fastener.

25. An adapter hook for supporting a storage bag, the storage bag being resealable at an upper end with a closure slider, that enables individual resealable bags to be installed on or removed from a support rod without requiring sequential installation or removal of other storage bags supported on the rod, comprising:

a closure slider of the resealable storage bag modified to include a first member of a ball-and-socket fastener disposed on an upper-most surface thereof; and an adapter hook fabricated of a thermoplastic resin and having a hook portion dimensioned to receive the support rod and a body portion having a second member of the ball-and-socket fastener disposed on a lower-most surface thereof for securing the adapter hook to the closure slider of the resealable bag;

wherein the adapter hook is configured to engage in a locking relationship with the closure slider when the first and second members of the ball-and-socket fastener are pressed toward each other to secure the adapter hook to the closure slider of the resealable bag.

26. The adapter hook of claim 25, wherein each member of the ball-and-socket fastener is configured to be coupled with the other member of the ball-and-socket fastener and to engage when pressed together, thereby securing the adapter hook to the closure slider of the resealable bag.

27. The adapter hook of claim 26, wherein the ball member portion and/or the socket member portion of the ball-and-socket fastener is longitudinally split along an axis of coupling to provide resilience in the respective member and enable repeated assembly and disassembly of the ball-and-socket fastener.

28. The adapter hook of claim 25, wherein the ball member of the ball-and-socket fastener is disposed on the upper-most surface of the closure slider of the resealable storage bag and the socket member of the ball-and-socket fastener is disposed on the lower-most surface of the adapter hook.

29. A method for supporting a storage bag, resealable at an upper end with a closure slider, that enables individual resealable bags to be installed on or removed from a support rod without requiring sequential installation or removal of other storage bags supported on the rod, comprising the steps of:

modifying the closure slider of the resealable storage bag to include a first member of a snap-together fastener disposed on an upper-most surface thereof;

providing an adapter hook fabricated of a thermoplastic resin and having a hook portion dimensioned to receive the support rod and a body portion having a second member of the snap-together fastener disposed on a lower-most surface thereof; and installing the body portion of the adapter hook having the second member of the snap-together fastener disposed on a lower-most surface thereof on the closure slider of the resealable storage bag having the first member of a snap-together fastener disposed on an upper-most surface thereof;

wherein the resealable bag having the adapter hook thus installed on the closure slider of the resealable storage bag may be hooked over the support rod at any available location along the support rod without requiring the removal of other storage bags supported on the support rod.

30. The method of claim 29, wherein the step of installing comprises the steps of:

aligning the second member of the snap-together fastener on the body portion of the adapter hook proximate the first member of the snap-together fastener on the body portion of the closure slider, wherein each member of the snap-together fastener is configured to be coupled with the other member of the snap-together fastener; and causing the first and second members of the snap-together fastener to engage when pressed together, thereby securing the adapter hook to the closure slider of the resealable bag.

31. The method of claim 30, wherein the step of aligning comprises the step of placing the first and second members of the snap-together fastener in contact with each other such that the first member is at least partially nested within the second member prior to being pressed together.

32. The method of claim 30, wherein the step of causing comprises the step of pressing each first and second member of the snap-together fastener toward each other until the first member and the second member of the snap-together fastener snap into a fully nested relationship with each other.

33. The method of claim 29, wherein the snap-together fastener formed in the adapter hook and the closure slider permits rotation of the first member within the second member such that the resealable storage bag may be rotated while supported on the support rod.

34. The method of claim 29, wherein the snap-together fastener formed in the adapter hook and the closure slider is reusable.

35. The method of claim 34, wherein the first member and/or the second member of the snap-together fastener is configured to provide resilience in the respective member and enable repeated assembly and disassembly of the snap-together fastener.

36. An adapter hook for supporting a storage bag, the storage bag being resealable at an upper end with a closure slider, that enables individual resealable bags to be installed on or removed from a support rod without requiring sequential installation or removal of other storage bags supported on the rod, comprising:

a closure slider of the resealable storage bag modified to include a first member of a snap-together fastener disposed on an upper-most surface thereof; and an adapter hook fabricated of a thermoplastic resin and having a hook portion dimensioned to receive the support rod and a body portion having a second member of the snap-together fastener disposed on a lower-most surface thereof for securing the adapter hook to the closure slider of the resealable bag;

wherein the adapter hook is configured to engage in a locking relationship with the closure slider when the first and second members of the snap-together fastener are pressed toward each other to secure the adapter hook to the closure slider of the resealable bag.

37. The adapter hook of claim 36, wherein each member of the snap-together fastener is configured to be coupled with the other member of the snap-together fastener and to engage when pressed together, thereby securing the adapter hook to the closure slider of the resealable bag.

38. The adapter hook of claim 37, wherein the first member and/or the second member of the snap-together fastener is configured to provide resilience in the respective member and enable repeated assembly and disassembly of the snap-together fastener.

39. The adapter hook of claim 36, wherein the first member of the snap-together fastener is disposed on the upper-most surface of the closure slider of the resealable storage bag and the second member of the snap-together fastener is disposed on the lower-most surface of the adapter hook.

40. The method of claim 1, wherein the step of installing comprises the steps of:

folding inside surfaces of first and second mirror-image halves of the adapter hook, hinged along an upper side in clamshell fashion, toward each other;

aligning an opening in a skirt portion of each of the first and second mirror-image halves of the adapter hook proximate first and second opposite sides of a body portion of the closure slider, wherein each opening in the skirt portion is shaped and sized to just fit over the respective opposite side of the body portion of the closure slider;

pressing the first and second mirror-image halves toward each other and over the first and second opposite sides of the body portion of the closure slider until the respective inside surfaces of the adapter hook contact the resealable bag; and holding the first and second mirror-image halves of the adapter hook together and enclosing the closure slider body while sliding an inverted, U-shaped resilient clip over a common edge of the adapter hook just above the closure slider to secure the mirror-image halves together, thereby securing the adapter hook to the closure slider of the resealable bag.

41. The adapter hook of claim 10, wherein the adapter hook further comprises an inverted, U-shaped resilient clip for sliding over a common edge of the adapter hook just above the closure slider to secure the mirror-image halves together.

* * * * *